US007868562B2

(12) United States Patent
Salsbury et al.

(10) Patent No.: US 7,868,562 B2
(45) Date of Patent: Jan. 11, 2011

(54) LUMINAIRE CONTROL SYSTEM AND METHOD

(75) Inventors: Marc Salsbury, Vancouver (CA); Ian Ashdown, West Vancouver (CA); Duncan L. B. Smith, Surrey (CA); Shane P. Robinson, Gibsons (CA); Ingo Speier, Saanichton (CA)

(73) Assignee: Koninklijke Philips Electronics N.V., Eindhoven (NL)

( * ) Notice: Subject to any disclaimer, the term of this patent is extended or adjusted under 35 U.S.C. 154(b) by 411 days.

(21) Appl. No.: 12/001,786

(22) Filed: Dec. 11, 2007

(65) Prior Publication Data

US 2008/0215279 A1 Sep. 4, 2008

Related U.S. Application Data

(60) Provisional application No. 60/869,538, filed on Dec. 11, 2006.

(51) Int. Cl.
*G05F 1/00* (2006.01)

(52) U.S. Cl. ..... 315/307; 315/300; 315/308

(58) Field of Classification Search ..... 315/291, 315/294, 297, 299, 300, 301, 307, 312, 326
See application file for complete search history.

(56) References Cited

U.S. PATENT DOCUMENTS

| | | | |
|---|---|---|---|
| 4,379,292 | A | 4/1983 | Minato et al. |
| 4,858,219 | A | 8/1989 | Yoshikawa |
| 4,962,687 | A | 10/1990 | Belliveau et al. |
| 5,019,747 | A | 5/1991 | Morita et al. |
| 5,073,863 | A | 12/1991 | Zhang |
| 5,329,431 | A | 7/1994 | Taylor et al. |
| 5,406,176 | A | 4/1995 | Sugden |
| 5,783,909 | A | 7/1998 | Hochstein |
| 5,971,579 | A | 10/1999 | Kim |
| 6,188,181 | B1 | 2/2001 | Sinha et al. |

(Continued)

FOREIGN PATENT DOCUMENTS

CA 2104738 A1 2/1994

(Continued)

OTHER PUBLICATIONS

Ian Ashdown: Radiosity; A Programmer's Perspective, New York, NY, John Wiley & Sons, 1994, pp. 200-202.

(Continued)

*Primary Examiner*—Douglas W Owens
*Assistant Examiner*—Jianzi Chen

(57) ABSTRACT

The present invention provides a system and method for controlling one or more light-emitting elements which are driven by forward currents to generate mixed light for use, for example, through a luminaire. The system has one or more light sensors for acquiring feedback optical sensor data and a user interface for providing reference data representative of a desired mixed light. The system also has a controller for transforming either the sensor data or the reference data into the coordinate space of the other and to determine a difference between the sensor and the reference data in that coordinate space. The controller is configured to adjust the forward currents during operating conditions so that the sensor data matches the setpoint data. The present invention also provides a system and method that can at least partially compensate certain temperature induced effects when transforming the optical sensor or the reference data.

22 Claims, 9 Drawing Sheets

U.S. PATENT DOCUMENTS

| | | | |
|---|---|---|---|
| 6,208,073 | B1 | 3/2001 | Wang et al. |
| 6,255,786 | B1 | 7/2001 | Yen |
| 6,331,063 | B1 | 12/2001 | Kamada et al. |
| 6,430,313 | B1 | 8/2002 | Smith et al. |
| 6,441,558 | B1 | 8/2002 | Muthu et al. |
| 6,462,669 | B1 | 10/2002 | Pederson |
| 6,482,004 | B1 | 11/2002 | Senn et al. |
| 6,507,159 | B2 | 1/2003 | Muthu |
| 6,552,495 | B1 | 4/2003 | Chang |
| 6,608,453 | B2 | 8/2003 | Morgan et al. |
| 6,617,795 | B2 | 9/2003 | Bruning |
| 6,741,351 | B2 | 5/2004 | Marshall et al. |
| 6,761,470 | B2 | 7/2004 | Sid |
| 6,870,325 | B2 | 3/2005 | Bushell et al. |
| 7,042,173 | B2 | 5/2006 | Huber |
| 7,140,752 | B2 | 11/2006 | Ashdown |
| 7,161,556 | B2 | 1/2007 | Morgan et al. |
| 7,253,566 | B2 | 8/2007 | Lys et al. |
| 2002/0078221 | A1 | 6/2002 | Blackwell et al. |
| 2003/0036807 | A1 | 2/2003 | Fosler |
| 2004/0105264 | A1 | 6/2004 | Spero |
| 2004/0225811 | A1 | 11/2004 | Fosler |
| 2005/0030538 | A1 | 2/2005 | Jaffar et al. |
| 2005/0289279 | A1 | 12/2005 | Fails et al. |
| 2006/0006821 | A1 | 1/2006 | Singer et al. |
| 2006/0022999 | A1 | 2/2006 | Lee et al. |
| 2006/0066265 | A1 | 3/2006 | Plotz et al. |
| 2006/0077192 | A1 | 4/2006 | Thielemans et al. |
| 2006/0077193 | A1 | 4/2006 | Thielemans et al. |
| 2006/0104058 | A1 | 5/2006 | Chemel et al. |
| 2006/0158881 | A1 | 7/2006 | Dowling |
| 2006/0193133 | A1 | 8/2006 | Von Der Brelie |
| 2006/0226956 | A1 | 10/2006 | Young et al. |
| 2006/0245174 | A1 | 11/2006 | Ashdown et al. |
| 2006/0273741 | A1 | 12/2006 | Stalker, III |

FOREIGN PATENT DOCUMENTS

| | | | |
|---|---|---|---|
| CA | 2258049 | C | 12/1997 |
| CA | 2328439 | A1 | 11/1999 |
| CA | 2583355 | A1 | 4/2006 |
| CA | 2591205 | A1 | 7/2006 |
| EP | 0482680 | A1 | 4/1992 |
| EP | 0728275 | B1 | 8/1996 |
| EP | 1416219 | A1 | 5/2004 |
| JP | 60163102 | A1 | 8/1985 |
| JP | 05088704 | A1 | 4/1993 |
| JP | 2004240815 | A1 | 8/2004 |
| WO | 9004275 | A1 | 4/1990 |
| WO | 9641098 | A1 | 12/1996 |
| WO | 03053108 | A1 | 6/2003 |
| WO | 2005025277 | A1 | 3/2005 |
| WO | 2006039789 | A1 | 4/2006 |
| WO | 2006056066 | A1 | 6/2006 |

OTHER PUBLICATIONS

B. T. Barnes, A Four-Filter Photoelectric Colorimeter, Journal of the Optical Society of America vol. 29, No. 10, 1939, pp. 448-452.

CIE. 2004, Colorimetry, Third Edition, Publication No. 15, 2004, Vienna. Austria: Central Bureau of the CIE.

Elation Professional: Focus Spot 250, Los Angeles California, Apr. 2005.

G. P. Eppeldauer, A Reference Tristimulus Colorimeter, Proceedings of the Ninth Congress of the International Color Association of the Optical Engineering Society, SPIE vol. 4421, 2002, pp. 749-752, Bellingham, WA.

G. D. Finlayson, et al: Constrained Least-Squares Regression in Color Spaces, Journal of Electronic Imaging, vol. 6, No. 4, 1997, pp. 484-493.

http://en.wikipedia.org/wiki/Adaptive_control, last modified on Aug. 22, 2010.

Madore, Colors and Colorimetry (http://www.madore.org/~david/misc/color/), 2008.

D. Malacara, 2002, Color Vision and Colorimetry: Theory and Applications. Bellingham, WA: SPIE Press, pp. 67.

MAZeT GmbH, JenColor: Color Measurement with MCS3 and MCSi via Calibration and Coefficient Matrix, (httpL://www.micropto.com/download/MAZeT/color%20measurement%20jencolor.pdf), 2004.

M. Rea, Ed. 2000, The IESNA Lighting Handbook, Ninth Edition. New York, NY: Illuminating Engineering Society of North America, pp. 27-4.

Adam Bennette, USITT DMX512/1990, Digital Data Transmission Standard for Dimmers and Controllers, Recommended Practice for DMX512, PLASA, 1994.

B. A. Wandell, et al: Water into Wine; Converting Scanner RGB to Tristimulus XYZ, Device-Independent Color Imaging and Imaging Systems Integration, Proc. SPIE 1909, 1993, pp. 92-101.

LUMINAIRE CONTROL SYSTEM AND METHOD

FIELD OF THE INVENTION

The present invention pertains to the field of lighting and in particular to control of color and intensity of light emitted by a light source.

BACKGROUND

Advances in the development and improvements of the luminous flux of light-emitting devices such as solid-state semiconductor and organic light-emitting diodes (LEDs) have made these devices suitable for use in general illumination applications, including architectural, entertainment, and roadway lighting. Light-emitting diodes are becoming increasingly-competitive with light sources such as incandescent, fluorescent, and high-intensity discharge lamps.

One of the challenges in solid-state lighting is to design a system and/or method that can set and maintain intensity and chromaticity of the mixed light emitted by a plurality of color, for example, blue and yellow or red, green, and blue LEDs. This can be challenging as the light emitted by LEDs may vary depending on operating conditions other than the electrical currents provided to the LEDs. Traditionally, systems that can rectify this dependency employ optical feedback based on signals provided by one or more optical sensors. The sensors can sense a portion of the emitted light and can be used to determine the chromaticity and the intensity of the sensed light. In turn, information about the chromaticity and intensity can be used to adjust the drive currents of the LEDs accordingly. However, a number of effects must be addressed to enable effective feedback control. For example, firstly, the spectral responsivities of known cost-effective RGB color sensors do not, for practical purposes, sufficiently closely mimic the spectral responsivity of the human eye. Secondly, the spectral power distributions (SPDs) of the LEDs can change with LED operating temperature.

For example, FIG. 1 illustrates the normalized spectral responsivity of a standard human observer as represented by the CIE color matching functions $\bar{x}(\lambda)$, $\bar{y}(\lambda)$, $\bar{z}(\lambda)$ along with the responsivity of typical commercially available RGB color sensors. It is clearly visible that the sensor characteristics do not closely match those of the standard human observer. Spectral mismatches, even smaller than the ones illustrated, can cause undesired light effects in feedback-controlled multi-color LED based systems.

As is well known in the art an SPD described by $\Phi(\lambda)$ can be transformed into corresponding CIE tristimulus values by determining the averages of the SPD weighted with the corresponding color matching functions. This can be expressed in the following equations for the above noted CIE color matching functions:

$$X=k\int\Phi(\lambda)\bar{x}(\lambda)d\lambda \tag{1a}$$

$$Y=k\int\Phi(\lambda)\bar{y}(\lambda)d\lambda \tag{1b}$$

and $$Z=k\int\Phi(\lambda)\bar{z}(\lambda)d\lambda \tag{1c}$$

As such tristimulus values determined based on signals provided by RGB color sensors with insufficiently accurate responsivities may not provide practically useful indications of the CIE tristimulus values. As is well known, other color matching functions may be used to determine the respective stimuli in the respective color space.

Known solutions such as exemplified by U.S. Pat. No. 6,507,159 disclose a method and a system for controlling a luminaire based on RGB LEDs that track the tristimulus values of both feedback and reference in a specific way. The forward currents driving the LED luminaire are adjusted based on a comparison between feedback tristimulus values and reference tristimulus values until the comparison yields no difference between the two. The tristimulus values are determined using certain filter sensor combinations. Matching the filters and sensors to accurately reproduce the CIE color matching functions, even under temperature-controlled laboratory conditions, however, is complex. Therefore, useful filter sensor combinations can be expensive, which are discussed by G. P. Eppeldauer, "A Reference Tristimulus Colorimeter," Proceedings of the Ninth Congress of the International Color Association of the Optical Engineering Society, SPIE 4421, pp 749-752, (2002), Bellingham, Wash., USA. Furthermore, feedback control that is only based on CIE tristimulus values does not separate chromaticity (i.e. color) from intensity and therefore may not be effective in suppressing a number of undesired chromaticity fluctuations.

B. T. Barnes describes in "A Four-Filter Photoelectric Colorimeter," Journal of the Optical Society of America 29, (10), pp 448-452, (1939), how to split the color matching function $\bar{x}(\lambda)$ into $\bar{x}_l(\lambda)$ and $\bar{x}_s(\lambda)$ by wavelength range and how this simplifies the spectral responsivity requirements for RGB sensors. Barnes defines:

$$\bar{x}_S(\lambda)=0 \text{ and } \bar{x}_L(\lambda)=\bar{x}(\lambda) \text{ if } \lambda>504 \text{ nm} \tag{2a}$$

$$\bar{x}_S(\lambda)=\bar{x}(\lambda) \text{ and } \bar{x}_L(\lambda)=0 \text{ if } \lambda<504 \text{ nm} \tag{2b}$$

where l and s stand for long and short wavelength region. For other than laboratory-quality instruments, it is common practice in the prior art to use appropriately scaled versions of the blue filter-detector pair response to represent both the $\bar{x}_s(\lambda)$ and $\bar{z}$ spectral responsivities. This approach, however, in general does not address how to mitigate undesired effects of RGB sensor spectral responsivity mismatches during operation.

B. A. Wandell and J. E. Farrell describe in "Water into Wine: Converting Scanner RGB to Tristimulus XYZ" Device-Independent Color Imaging and Imaging Systems Integration, Proc. SPIE 1909, pp 92-101, (1993), how to transform RGB sensor data into XYZ tristimulus values by using a transformation matrix that can be predetermined from a least squares solution during a calibration step. The calibration step utilizes data from ideal CIE color matching sensors and calibration data from non-ideal RGB sensors are obtained from measurements of a set of SPDs per sensor. However, Wandell do not teach the use of the least-squares solution with a real-time feedback apparatus, or its application to light source control. The transformation is only applied to the measured RGB color sensor data of each pixel of an image.

G. D. Finlayson and M. S. Drew describe in "Constrained Least-Squares Regression in Color Spaces," Journal of Electronic Imaging 6, (4), pp 484-493, (1997), a method similar to the solution by Wandell et al. above that suffers from the same limitations.

FIG. 2 illustrates an example of the SPDs of light emitted by a RGB LED module at two different operating temperatures but otherwise the same static operating conditions. The ambient temperature is once 25° C. and once 70° C. Further to the effects of different operating temperature, different LED drive currents in different color LEDs can result in different rates of power dissipation and consequently different LED junction temperatures. This can manifest when comparing the SPDs in that different peak wavelengths shift and different SPDs broaden differently and hence can cause the chromaticity of the mixed light to change in a nonlinear fashion depending on the drive currents and the operating temperatures of each LED. In addition, thermal coupling between different color LEDs can cause interdependencies between the LED junction temperatures. Consequently, the well-known Grassman laws of color additivity may not provide accurate descriptions of the color of the mixed light without consideration of self and cross heating effects of the LEDs and any optical sensors employed to sense the generated light.

Luminaire feedback control systems can therefore suffer from a number of effects including the issue that RGB sensors with different sensitivities will provide different unique responses to light of the same SPD. Changes in the SPDs of color LEDs as described above will also cause variations in the responses of RGB sensors. Hence, variations of RGB sensor signals in response to variations of the SPD will also be unique. Furthermore, RGB sensors that approximate ideal sensors will, in response to the same SPD, provide different signals compared to ideal sensors. Furthermore, the responsivity of an RGB sensor may also vary with its temperature.

Therefore there is a need for a luminaire control system and method that can effectively control the light generated by a luminaire.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a luminaire control system and method. In accordance with an aspect of the present invention, there is provided a method for controlling one or more light-emitting elements (LEEs) driven by forward currents to generate a mixed light. The method comprises the steps of acquiring sensor data representative of the mixed light; providing setpoint data representative of a desired mixed light; transforming the sensor data into first data expressed in coordinates of a predetermined color coordinate system; transforming the setpoint data into second data expressed in coordinates of said predetermined color coordinate system; comparing the first and the second data and determining a difference between the first and the second data; adjusting said forward currents in response to the difference between the first and the second data in order to decrease the difference between said first data and said second data.

In accordance with another aspect of the present invention, there is provided a system for controlling one or more light-emitting elements (LEEs) driven by forward currents to generate a mixed light. The system comprises one or more optical sensors for acquiring sensor data representative of the mixed light; a user interface for providing setpoint data representative of a desired mixed light; a controller, the controller transforming the sensor data into first data expressed in coordinates of a predetermined color coordinate system, the controller further transforming the setpoint data into second data expressed in coordinates of said predetermined color coordinate system, the controller further comparing the first and the second data and determining a difference between the first and the second data, the controller further adjusting said forward currents in response to the difference between the first and the second data; wherein the controller is configured to decrease the difference between said first data and said second data until an absolute value of said difference falls below a predetermined threshold.

DETAILED DESCRIPTION OF THE INVENTION

Definitions

Figure 1:
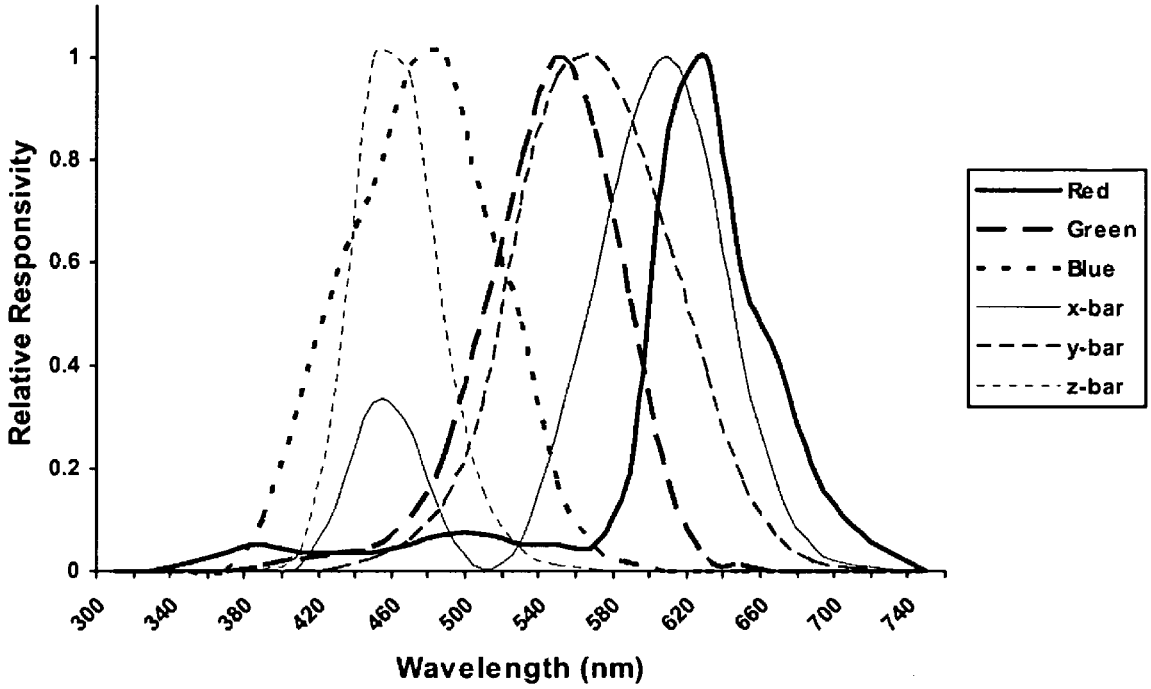
FIG. 1 illustrates the normalized spectral responsivity of a standard human observer as represented by the CIE color matching functions $\bar{x}(\lambda)$, $\bar{y}(\lambda)$, $\bar{z}(\lambda)$ and the responsivity of a set of typical commercially available RGB color sensors.
Figure 2:
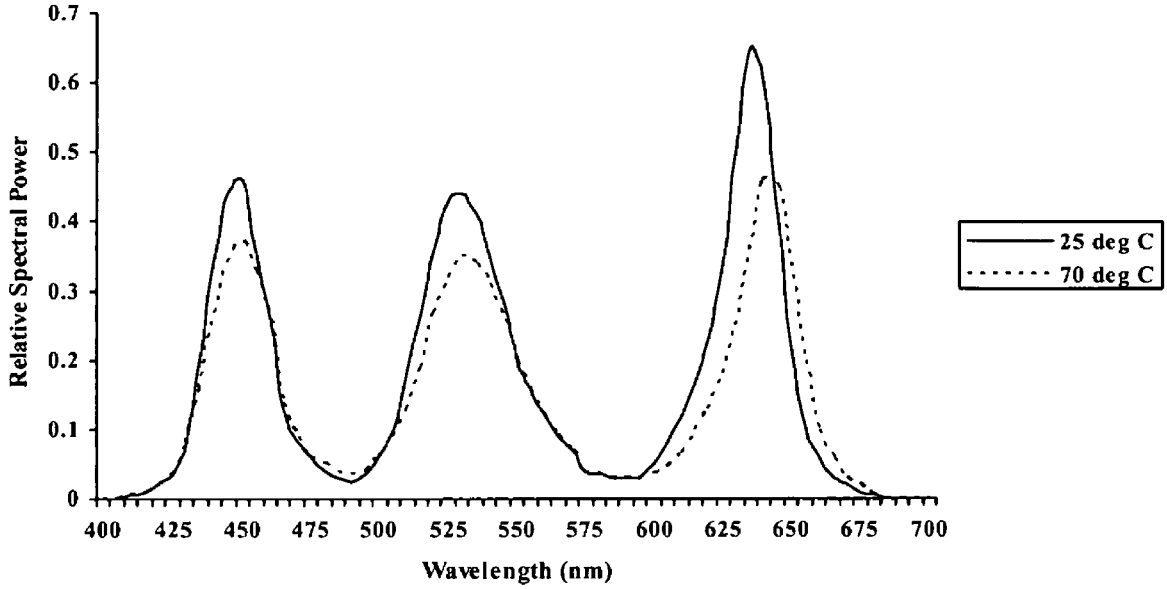
FIG. 2 illustrates an example of two SPDs for a RGB LED module operated at 25 deg C. and 70 deg C. ambient temperature.

The term "light-emitting element" (LEE) is used to define a device that emits radiation in a region or combination of regions of the electromagnetic spectrum for example, the visible region, infrared and/or ultraviolet region, when activated by applying a potential difference across it or passing a current through it, for example. Therefore a light-emitting element can have monochromatic, quasi-monochromatic, polychromatic or broadband spectral emission characteristics. Examples of light-emitting elements include semiconductor, organic, or polymer/polymeric light-emitting diodes, optically pumped phosphor coated light-emitting diodes, optically pumped nano-crystal light-emitting diodes or other similar devices as would be readily understood by a worker skilled in the art. Furthermore, the term light-emitting element is used to define the specific device that emits the radiation, for example a LED die, and can equally be used to define a combination of the specific device that emits the radiation together with a housing or package within which the specific device or devices are placed.

As used herein, the term "about" refers to a +/−10% variation from the nominal value. It is to be understood that such a variation is always included in any given value provided herein, whether or not it is specifically referred to.

Unless defined otherwise, all technical and scientific terms used herein have the same meaning as commonly understood by one of ordinary skill in the art to which this invention belongs.

The present invention provides a feedback and control system for controlling the electrical currents provided to one or more LEEs in a luminaire. The feedback and control system can interoperate with optical sensors for sensing a portion of the light emitted by the LEEs, a user interface for information exchange with a user and a temperature sensor system. The temperature sensor system can comprise a LEE-junction temperature-sensor system for monitoring the temperature of the LEEs and further optionally a sensor-temperature system for monitoring the temperature of the optical sensors.

According to the present invention, the feedback and control system can be configured so that certain signals used thereby correlate with the color or intensity of light in coordinates of a chosen predetermined desired color space. The degree of the correlation can be directly linear proportional. These signals can include input and output signals of the system or signals that are derived therefrom by transformation into the predetermined desired color space. These signals can include signals indicating the setpoint of the system. The setpoint of the system describes the desired output of the system and may be changed by the user during operation triggering a transition between two desired states. The system may be configured to perform the transition in a number of typically predetermined ways.

For feedback control, output and setpoint signals can be compared for purposes of determining differences between the two. A difference is typically considered a deviation of the output from the setpoint. Each difference is then used to determine changes to the respective electrical drive current per group of LEEs that is required to reduce the difference between respective instant and desired output of the luminaire. The information encoded in the setpoint signal or the sensor signal or both therefore needs to be available in a common color space before they can be compared. Hence, either one or both of the signals may need to be transformed into the chosen common color space. According to the present invention, the common color space is the predetermined desired color space discussed above. In general, the controller is configured to adjust, in response to the comparison of the instant and desired output, the drive currents to the light-emitting elements. According to an embodiment of the present invention, the drive currents are adjusted to reduce the difference between the feedback RGB sensor data, which express the instant output, and the setpoint RGB data describing the desired output, until an absolute value of the difference is smaller than a predetermined threshold.

According to an embodiment of the present invention, the common color space may be defined by the responsivities of the optical sensors at certain predetermined operating conditions of the optical sensors. In particular, each of the responsivities may be used as a basis function of the coordinate system that is employed to define the predetermined desired color space.

It is noted that the above instant output refers to the output at the times the light emitted by the LEEs of the luminaire was interacting with the respective sensor. The instant output will typically be processed later and the delay will depend on the nature of the feedback system. As is known, the instant value of a feedback signal at times when it is actually processed typically corresponds to earlier outputs depending on the time it takes to propagate the output signal through portions of the feedback system until it is processed by the feedback and control system. In digital control systems, additional delays may arise because samples of the fed back output signal may be taken only at intervals or at certain times. Delays in feedback and control systems may also arise from holding data from sampled signals in storage until processed.

According to an embodiment of the present invention, the feedback and control system is configured to transform RGB sensor data into coordinates of the reference data and compare the two. According to another embodiment, the feedback and control system is configured to transform the reference data into coordinates of the RGB sensor data and compare the two. According to another embodiment, the feedback and control system is configured to transform the reference and the RGB sensor data into coordinates of a predetermined color space that is different from both the color space of the reference and the RGB sensor data. Generally the feedback and control system is configured to adjust forward drive currents to the light-emitting elements, in response to the comparison of output or sampled signals and the setpoint signals, to decrease the difference between said RGB sensor data and the reference RGB data until an absolute value of the difference no longer exceeds a desired predetermined threshold.

Control Methods and Dynamics of the Feedback and Control System

According to the present invention, whenever the feedback and control system processes input or setpoint values, or output signals, for example, in order to determine the deviation of the output from the setpoint, certain operational conditions and information about the operating mode of the system may need to be considered. The system may be in a static operating mode in which the input and output parameters of the system as apparent to a user do not change or the system may operate in a transitional mode wherein output parameters are changing as a result of changes to input parameters. Although input and output parameters may not change, internal system parameters and variables describing the state of the system or its components may vary. Transitional modes include, for example, when the color or intensity of the light emitted by the luminaire transitions from an initial to a desired target value. Consequently, the feedback and control system needs to detect and adequately process the system state also when transitional modes are active.

According to the present invention, a digital feedback and control system, for example, may effect a transition in a stepwise iterative manner, altering color or chromaticity or both in incremental steps of either predetermined or dynamically determined size at a time until the desired output is achieved. If a transition is in progress and a command is received that requires a new transition, the feedback and control system may wait for completion of the initial transition before it initiates the new transition. Alternatively, the system may, while the initial transition is ongoing, update the transition parameters and, if necessary, adjust the timing of the transition so that it can be achieved according to a predetermined or otherwise desired schedule. Different embodiments may utilize these different approaches in various different combinations.

The control system may also perform overlapping transitions in a time-multiplexed fashion and may be configured to complete, update or even interrupt one or more of the ongoing transitions in a predetermined manner. The control system may also be configured to synchronize overlapping time-multiplexed transitions in order to achieve desired lighting effects. Different embodiments may be configured to perform step-wise transitions at different rates or frequencies. For example, step-wise intensity adjustments may be performed at 50 Hz.

As the feedback and control system determines new drive currents for the LEE of the luminaire, it can also verify that drive currents do not exceed maximum drive currents permissible according to the design and operating conditions of the overall system including the luminaire at the time. According to an embodiment of the present invention, the feedback and control system may scale back drive currents from initially determined values in order to prevent one or more effects that may be undesirable or detrimental to system components including the luminaire. Such effects may include overheating, flicker and undesired color drifts because of increases in intensity, for example. Drive currents may be scaled back in a number of different predetermined ways, which may be different depending on the specific cause or effect that is sought to be mitigated. This may include dimming of one or more LEEs that themselves may not even be overheating but need to be dimmed in order to maintain a desired chromaticity, for example, because the drive current for one or more other LEEs needs to be reduced to prevent them from overheating.

It is noted that drive currents may be provided in a number of different formats including analog or pulsed formats, for example. Pulsed formats may include pulse width modulated, pulse code modulated or pulse density modulated drive currents. It is also noted that a pulsation scheme may be additionally modulated by frequency, amplitude or pulse duration in order to improve time-averaged drive current resolution, suppress undesired flicker at low average drive currents or encode additional information in the light generated in response to the drive current, for example. Therefore drive current control and scaling may be a matter of adjusting, for example, pulse width, pulse amplitude or pulse density of the drive currents. It is noted that different embodiments may employ one of these or other well known digital as well as analog drive current control schemes or a combination of them.

The system may perform intensity transitions based in a perceptually linear fashion including square law or logarithmic dimming, for example, or other alternative desired predetermined dimming curves may be used.

For improved stability and response time, the feedback and control system may be configured to change a number of internal control parameters in a predetermined way depending on the magnitudes of the drive currents or the strength of the feedback or sensor signals. Internal control parameters may be calibration factors for determining respective proportional integral differential (PID) difference signals or other known parameters that may be adjusted in order to effect the dynamics of the feedback and control system. For this purpose, the feedback and control system may acquire and maintain data about characteristic operating conditions and utilize this data for self-calibration purposes and improved control. Different embodiments may store this data in non-volatile memory and engage a self-calibration temperature evaluation based upon predetermined schemes, for example, when operating within a predetermined range of operating conditions or at predetermined intervals or frequencies, for example.

Figure 3:
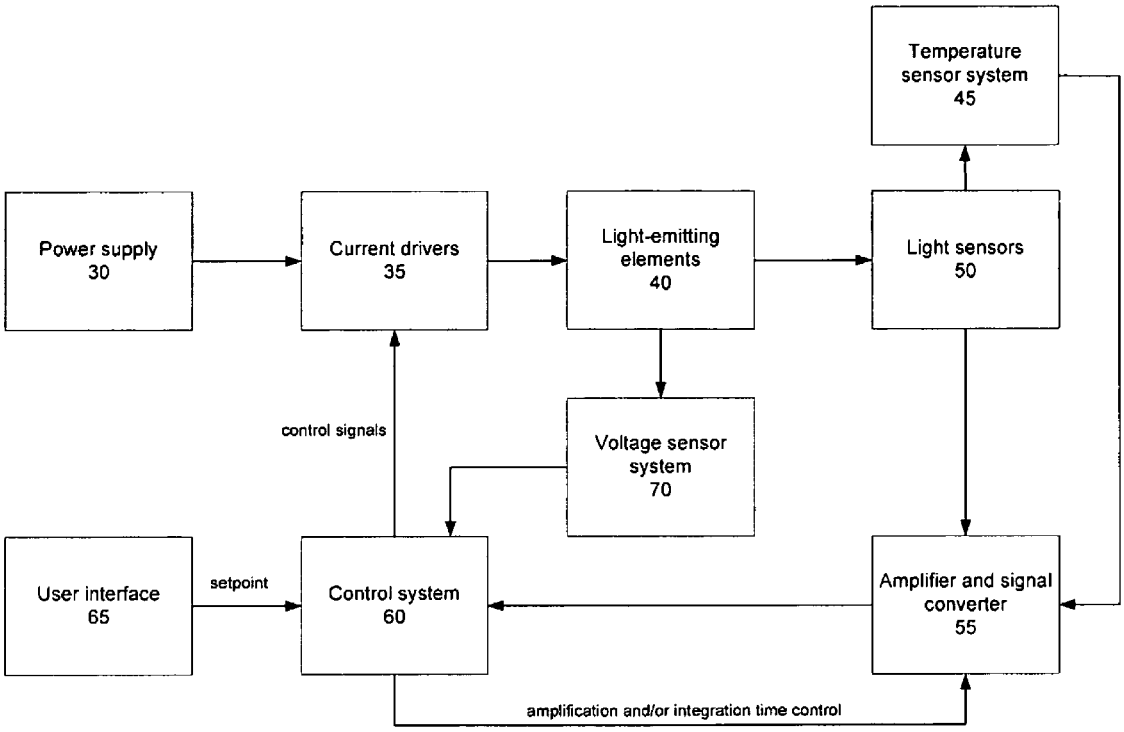
FIG. 3 illustrates the architecture of a feedback and control system for LEE based luminaire according to an embodiment of the present invention.

Architecture of a Luminaire-based System Employing a Feedback and Control System FIG. 3 illustrates an example architecture of a combination of a luminaire employing a feedback and control system according to the present invention. The luminaire comprises one or more LEEs 40 for generating light. The LEEs 40 are electrically connected to the power supply 30 via the current drivers 35. The power supply 30 can be based on an AC/DC or DC/DC converter, for example. A luminaire with multiple color LEEs, can comprise separate current drivers for each color. Separate current drivers can be used to supply different forward currents to different color LEEs 40 at a time.

One or more RGB sensors 50 are provided which can be calibrated to sense the luminous flux output of the light generated by the luminaire. In one embodiment, separate light sensors 50 are provided for each color of the LEEs 40. In addition, a color filter can be associated with one or more of the light sensors 50. Each RGB sensor 40 is electrically connected to an amplifier and signal converter 55 that can convert the sensed signal into an electrical signal that can be processed by the control system 60.

As illustrated, the control system 60 can control the amplification and integration control signals of the amplifier and signal converter 55. It is understood, that each RGB sensor 50 can detect an amount of luminous flux that is sufficient to provide a stable photocurrent and that provides a signal with an adequate signal-to-noise ratio. The RGB sensors 50 may be shielded to suppress stray or ambient light from being sensed by them. Alternative embodiments, however, may be configured to detect ambient light, for example.

A user interface 65 is coupled to the control system 60 and provides a means for obtaining information relating to a desired color temperature, chromaticity and/or desired luminous flux output for the luminaire from a user or other control device, such as for example a programmable 24-hour timer, a theatrical lighting console or other suitable device as would be readily understood by a worker skilled in the art. The whole system including the user interface may be configured in a number of different ways to allow different ways of controlling the light emitted by one or more luminaires. Possible system configurations may provide the user with capabilities ranging from directly altering the emitted light to entering information to preprogram a lighting program that may be executed by the system automatically at desired times, intervals and so forth.

The information provided by the user interface is converted into appropriate electrical reference signals for use by the control system 60. The control system 60 additionally receives feedback data from the light sensors 50 relating to the luminous flux output from the luminaire. The control system 60 can thereby determine appropriate control signals for transmission to the current drivers 35 in order to obtain the desired luminous flux and chromaticity of light generated by the luminaire. The control system 60 can be a microcontroller, microprocessor or other digital signal processing system as would be readily understood by a worker skilled in the art.

In one embodiment, and as illustrated in FIG. 3, the control system 60 can optionally be operatively coupled to one or more LEE temperature sensors 45. The LEE temperature sensors 45 provide information about the temperature of the LEEs 40 under operating conditions. Information about the temperature of the LEEs 40 can then be used to compensate for temperature-induced luminous flux variations and characteristic LEE specific temperature-induced peak-center wavelength shifts.

For example, the temperature of LEEs 40 can be determined by measuring the forward voltage of that LEE, by measuring the resistance of a thermistor that is in thermal contact with the LEEs, or the voltage of a thermocouple. Consequently, the control system 60 can control the current drivers 35 to adapt the drive current for the group of LEEs 40 in a feed-forward manner.

Similarly, one or more temperature sensor elements 45 can provide information about the operating temperature of the optical RGB sensors 50. This information can be used to account for temperature-dependent changes to the spectral responsivity of the optical sensors and compensate for undesired respective effects.

In one embodiment, the control system 60 responds to signals from both the RGB sensors 50 and the temperature sensors 45, as a digital feedback control system 60 responding to only the light sensors 50 can exhibit lower long-term stability in the maintenance of constant luminous flux output and chromaticity.

According to embodiments of the present invention, a temperature sensor element can be a forward voltage sensor system or other temperature sensor element for determining the operating temperature of the LEEs of the luminaire. As illustrated in FIG. 3, embodiments of the control system can be configured to process signals provided by one or more voltage sensor elements 70. The voltage sensor elements are operatively connected to the LEEs of the luminaire in order to sense the forward voltage of the LEEs 40. As would be known in the art, the voltage sensor signals can be processed based upon the instantaneous drive currents of the respective LEEs in order to determine the junction temperature of the LEEs. For example, the voltage sensor signals can be filtered with a bandpass filter with a center frequency equal to about twice that of the AC line frequency. The control system 60 can optionally continually sample the voltage sensor signals to measure the residual ripple current which can arise from incomplete power supply filtering and adjust the duty cycle of the PWM drive signals to current drivers 35 in order to mitigate undesired effects on the luminous flux output from the LEEs 40. The sampling frequency of the voltage sensor signals can be configured to typically be greater than about 300 Hz in order to minimize visual flicker.

The invention will now be described with reference to specific example. It will be understood that the following examples are intended to describe embodiments of the invention and are not intended to limit the invention in any way.

EXAMPLES

Example 1

In a first example, the control system can be configured to read the RGB sensor data [R G B] and apply a predetermined transformation in order to derive approximate values of the CIE tristimulus values X, Y and Z of the light emitted by the LEEs. This can be performed by, for example, programming the control system with the linear algebraic relation $$[XYZ]=[RGB]T \tag{3}$$

using the 3×3 transformation matrix $$T=(N^TN)^{-1}N^TM=N^+M \tag{4}$$

$N^T$ is the transpose and $N^+$ is the pseudoinverse of N. M is an n×3 matrix of ideal tristimulus values $M_{ij}$ and N is a corresponding n×3 matrix of RGB color sensor data for the same set of n SPDs. M and N can be determined during a calibration step that utilizes the n SPDs and characterizes them with the RGB color sensors to determine N and, for example, with an accurately calibrated spectrometer to determine M. T can subsequently be determined, for example, through a least squares solution, by minimizing the error function $$\mathfrak{I} = \sqrt{\sum_{i=1}^{n}\sum_{j=1}^{3}(M_{ij}-[NT]_{ij})^2} \tag{5}$$

This method can provide a means to mitigate the average RMS error in tristimulus space between the measured RGB sensor data and the measured ideal sensor data for the training set of SPDs. It is noted that a [X Y Z] which are obtained from [R G B] of a SPD using the T obtained during the calibration process are linearly interpolated approximations.

As is well known in the art $$x = \frac{X}{X+Y+Z} \tag{6}$$

and $$y = \frac{Y}{X+Y+Z} \tag{7}$$

with the intensity being represented by the CIE tristimulus value Y. In one embodiment the controller is configured with a different predetermined matrix $T_{xyY}$ to convert [R G B] values to coordinate space [x y Y] with chromaticity coordinates x, y and intensity Y directly in which case $$[xyY]=[RGB]T_{xyY} \tag{8}$$

It is noted that each set of RGB values is associated with a specific chromaticity and intensity. If the gains of the RGB sensors scale, for practical purposes, sufficiently linear with intensity, desired changes in intensity can therefore be effected by the control system by adequately scaling all RGB values.

In addition, error functions other than the one of Equation 5 can be used, for example, the sum of the absolute differences. Furthermore, each of the values in the [X Y Z] and/or [R G B] matrices can be given different weights in the error function in order to achieve different desired control effects.

The minimization procedure can utilize coordinate spaces other than [x Y Z]. It is noted, the CIE 1931 Chromaticity coordinates x and y are perceptually nonlinear and that, given that the color feedback system controls a light source, it can be advantageous to linearize x and y in a perceptual sense. For example, the CIE 1976 Uniform Chromaticity Scale (UCS) color space coordinates, provide this form of linearization and are given by (CIE 2004) as $$u' = \frac{4x}{-2x+12y+3} \tag{9}$$

and $$v' = \frac{9x}{-2x+12y+3} \tag{10}$$

The coordinates [u' v' Y] can therefore be used in embodiments of the present invention. It is noted that it is also possible to transform into other perceptually uniform color spaces such as CIELAB, where the metric is the color difference $\Delta E^*_{ab}$. This entails a nonlinear transformation of the tristimulus values, which may require more complex processing.

An advantage of using xyY or u'v'Y coordinates for color feedback control is that color and intensity are represented separately. Desired changes in intensity can therefore be effected by scaling Y without requiring additional calculations on xy or u'v'. The separation into uncoupled color and intensity parameters that can be practically independently varied substantially without affecting another, can help reduce undesired chromaticity shifts due to floating point calculation quantization errors during digital processing.

Example 2

In another embodiment, it may be advantageous in terms of computational efficiency to operate the control system using feedback raw RGB sensor data directly. In such an embodiment, it is no longer necessary for the control system to transform the RGB sensor data each time it is fed back. Instead the user-specified input data is transformed into RGB sensor coordinates from coordinates such as XYZ tristimulus or xyY chromaticity and intensity, for example, in order for the control system to compare the setpoint with the RGB color feedback data. In such an embodiment, a transformation needs to take place only when the user-specified input data changes. In this embodiment the control system operates in RGB sensor coordinates to set and maintain desired chromaticity and intensity.

For a predetermined transformation T, the target RGB values can be determined from:

$$[R_T G_T B_T]=[XYZ]T^{-1} \tag{11}$$

It is noted that the transformation T used in Equation 11 may the determined as described above. Alternatively, $T^{-1}$ may be determined directly in the same way as described above except with the respective error function defined in XYZ color space coordinates rather than the RGB values in RGB color space coordinates used in Equation 5.

If $0 \leqq R_T \leqq R_{max}$, $0 \leqq G_T \leqq G_{max}$ and $0 \leqq B_T \leqq B_{max}$, and where $R_{max}$, $G_{max}$ and $B_{max}$ are the maximum attainable values for the respective RGB color sensor outputs when the LEEs are operated at full power, then the user-specified XYZ or other, for example, xyY values are within the color and intensity gamut of the LEEs. If any of these conditions are not satisfied, then the specified color and/or intensity cannot be attained by the LEEs.

Example 3

In this embodiment the controller is configured to transform each of one or more predetermined RGB sensor data into a respective predetermined desired color space, for example XYZ data while the rest of a training set of the RGB sensor data is transformed as described even if the average least squares error for the rest of the data is increased. This embodiment may be utilized to ensure that the control system can perform a calibration process that preserves white light RGB sensor data as such.

The additional constraint for the calibration method can be expressed as $M_w=N_w T$ where $N_w$ is the RGB sensor data of the predetermined "white" SPD, and $M_w$ are the corresponding XYZ tristimulus values. The transformation matrix can be determined by:

$$T_j = (N^T N)^{-1} N^T M_j + \frac{\left(1 - M_j^T N[N^T N]^{-1} N_w\right)}{(N_w^T [N^T N]^{-1} N_w)} [N^T N]^{-1} N_w \tag{12}$$

where $T_j$ is the $i^{th}$ column of T, $M_j$ is the $j^{th}$ column of M, and $M_w$=[1 1 1].

In one embodiment the controller is configured with CIE 1976 UCS color space coordinates u' and v' and intensity Y in favour of CIE tristimulus values XYZ.

Example 4

In one embodiment of the present invention, a form of the least squares approach can be used for transforming between colour coordinate systems. The least-squares and constrained least-squares solutions are both linear affine transformations between RGB coordinates and the XYZ tristimulus coordinates. This implicitly assumes that the nonlinearities of the LED drivers and the RGB color sensors are sufficiently small such that the maximum error is as follows:

$$\Delta E_{max} = \max\left(\sqrt{\sum_{j=1}^{3} (M_j - [NT]_j)^2}\right) \tag{13}$$

and is acceptably small for all practical purposes and RGB sensor data for this embodiment.

Figure 4:
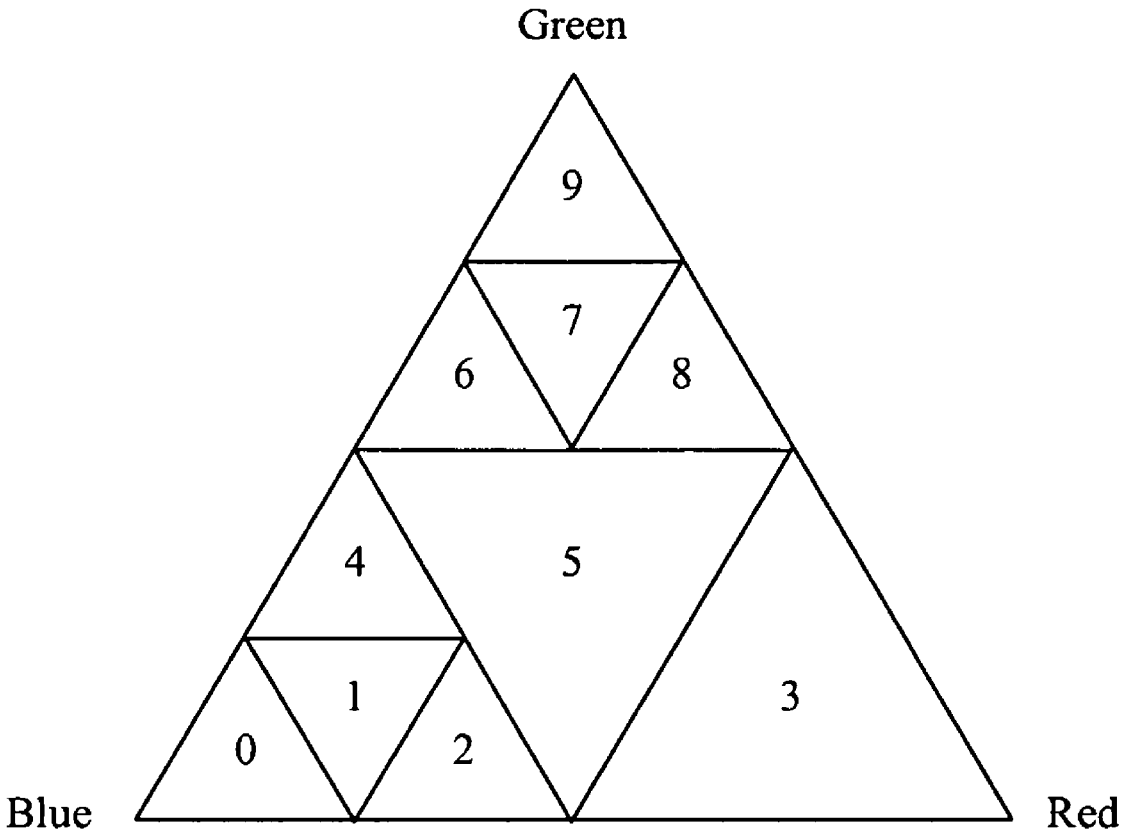
FIG. 4 illustrates an example of a recursive triangular subdivision of an RGB color space according to an embodiment of the present invention.

If for example, $\Delta E_{max}$ exceeds a predetermined threshold, the color gamut of the RGB LEEs in RGB color space coordinates can be subdivided. This can be facilitated by increasing the number of sample points for the interpolation and employing a more refined sample raster of the color space. This can be facilitated, for example, as illustrated in FIG. 4. FIG. 4 illustrates an example of a recursive triangular subdivision of an RGB color space. Corresponding target coordinates, for example u'v' or u'v'Y, of the vertices of each triangle t can then be used to calculate one transformation matrix $T_t$ for each triangle t. A set of RGB color space coordinates within the gamut of the LEEs can then fall within one specific triangle and can then be transformed using the transformation matrix $T_t$ for that triangle.

An aspect to consider when determining the transformation matrices $\{T_t\}$ is that an adjacent pair of these matrices transform a data along the common edges and vertices into the same target coordinates irrespective of which one of the two matrices is being used in the transformation of RGB vectors. This can be facilitated by employing appropriate boundary conditions to the error functions when determining the least square solution for the triangulated grid.

For example, given a measured RGB vector, it is necessary to determine which triangle it occupies and so which transformation matrix should be applied. An example method comprises the following:

```
Input: R, G, B
const n = 4
Array: M[n][n][n]
// Normalize RGB sensor values
Rnorm = R / Rmax
Gnorm = G / Gmax
Bnorm = B / Bmax
// Determine array indices
x = R * n / (R + G + B)
y = G * n / (R + G + B)
z = B * n / (R + G + B)
// Determine transformation matrix index
t = M[x][y][z]
```

where $n=2^s$ with s being the level of recursive subdivision, and M is a three-dimensional array with stored triangle indices. About three-quarters of the array elements will be invalid, as they cannot be indexed by xyz. If it is necessary to conserve memory, M can be stored as a sparse array using known computer science techniques, or the array can be implemented programmatically using a decision tree. The recursive triangles solution is also described in U.S. Pat. No. 7,140,752 where the multivariate function defining the hyperplane representing constant luminous intensity and chromaticity is represented by a piecewise linear function rather than a radial basis function.

Example 5

In the above embodiments the control system can be optionally be combined with a temperature compensation method. As noted, SPDs of LEEs as well as channel gains of RGB color sensors may exhibit significant temperature dependencies. Consequently, the RGB color sensor data can depend on the operating temperature of the LEEs and possibly on that of the RGB sensors, wherein these dependencies can be identified in one or more of the transformation matrices T defined above.

In one embodiment the temperature dependencies of the SPDs and RGB channel gains may be linearly interpolated across the whole range of operating temperatures thereof and the control system can be configured using transformation matrices for predetermined one or more low operating temperatures and another one or more transformation matrices for predetermined one or more high operating temperatures. Transforming RGB sensor data into, for example u'v'Y or xyY, at a measured one or more temperatures is then a matter of linearly interpolating the transformed RGB sensor data of the high and the low temperature transformations. In this embodiment the feedback system can be equipped with means for obtaining the temperature of the LEEs and/or the RGB sensors. For operating temperatures between these extremes, two sets of color feedback system parameters can be determined using both matrices, and the desired parameters can be linearly interpolated between these values for each color channel.

In another embodiment the control system can be configured to piecewise linearly interpolate within each of a set of predetermined contiguous operating temperature intervals. The operating temperature intervals can cover the complete desired range of operating temperatures. This may help suppress the generation of perceivable lighting artefacts caused by linearly interpolating across the complete range of operating temperatures using only one interval.

Figure 5:
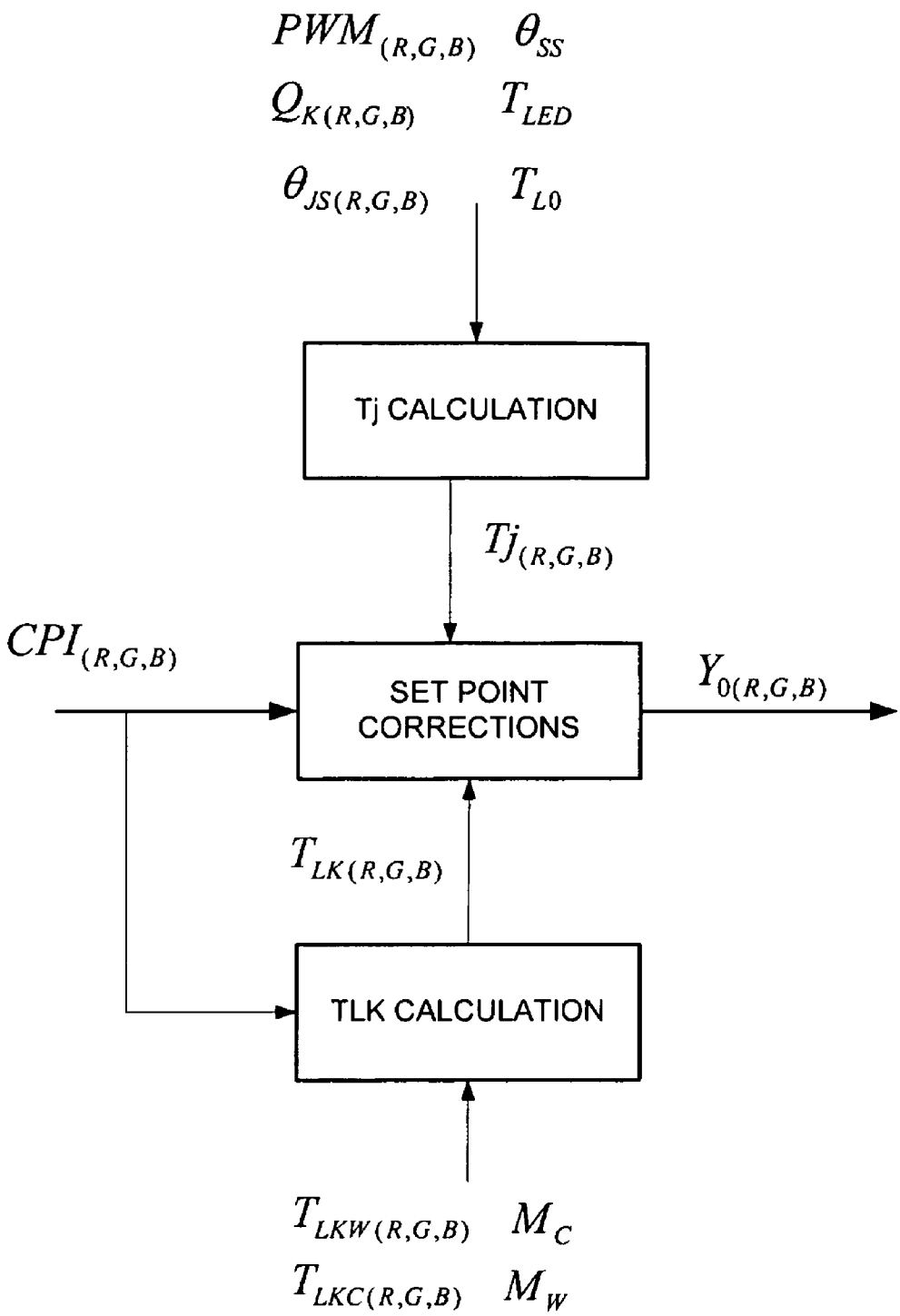
FIG. 5 illustrates a block diagram of an example LEE operating temperature compensation method according to one embodiment of the present invention.

FIG. 5 illustrates a block diagram of an example LEE operating temperature compensation method in accordance with an embodiment of the present invention. In a first step, a LEE operating temperature is determined, for example, based on signals obtained from a temperature sensors or forward voltage sensors. It is noted that for digital processing the sensor signals may be converted from analog to digital format. LEE operating temperatures for a RGB based LEE luminaire with a corresponding number of sensors may be determined according to the following table.

| | Meaning |
|---|---|
| Input: | $T_{LEE}$ - LEE substrate temperature<br>$PWM_{(R,G,B)}$ - Current PWM levels |
| Output: | $Tj_{(R,G,B)}$ - LEE junction temperature |
| Constants: | $Q_{k(R,G,B)}$ - Heat load<br>$\theta_{SS}$ - Thermal resistance, substrate to sensor<br>$\theta_{JS(R,G,B)}$ - Thermal resistance, junction to substrate |
| Transformation: | See following equations for $Tj_{(R,G,B)}$ |

-continued

| Meaning |
|---|
| $Tj_{(R)} = T_{LED} + \left(\frac{PWM(R)}{2^{16}} \times Q_{K(R)} \times \theta_{JS(R)}\right) + \left(\left[\frac{PWM(R)}{2^{16}} \times Q_{K(R)} + \frac{PWM(G)}{2^{16}} \times Q_{K(G)} + \frac{PWM(B)}{2^{16}} \times Q_{K(B)}\right] \times \theta_{SS}\right)$ |
| $Tj_{(G)} = T_{LED} + \left(\frac{PWM(G)}{2^{16}} \times Q_{K(G)} \times \theta_{JS(G)}\right) + \left(\left[\frac{PWM(R)}{2^{16}} \times Q_{K(R)} + \frac{PWM(G)}{2^{16}} \times Q_{K(G)} + \frac{PWM(B)}{2^{16}} \times Q_{K(B)}\right] \times \theta_{SS}\right)$ |
| $Tj_{(B)} = T_{LED} + \left(\frac{PWM(B)}{2^{16}} \times Q_{K(B)} \times \theta_{JS(B)}\right) + \left(\left[\frac{PWM(R)}{2^{16}} \times Q_{K(R)} + \frac{PWM(G)}{2^{16}} \times Q_{K(G)} + \frac{PWM(B)}{2^{16}} \times Q_{K(B)}\right] \times \theta_{SS}\right)$ |

For white light, a further temperature correction factor can be calculated. This correction factor may be composed of a temperature calibration at two points on the black body locus. These constants can then be linearly varied across the locus based on a mirek input of the current target CCT. An example implementation of this calculation is illustrated in the following table.

| | Meaning |
|---|---|
| Input: | CCT - Target correlated color temperature<br>$CP_{(R,G,B)}$ - Color point, no intensity scaling |
| Output: | $T_{LK(R,G,B)}$ - LED temperature correction factors |
| Constants: | $M_w$ - Mirek value of calibrated warm CCT<br>$M_c$ - Mirek value of calibrated cool CCT<br>$T_{LKW(R,G,B)}$ - Warm CCT temperature correction factor<br>$T_{LKC(R,G,B)}$ - Cool CCT temperature correction factor |
| Transformation: | See following equations for $T_{LK(R,G,B)}$ |
| | $T_{LK(R,G,B)} = T_{LKW(R,G,B)} \times \left(1 - \left[\frac{M_W - \frac{1000000}{CCT_setting}}{M_W - M_C}\right]\right) + T_{LKC(R,G,B)} \times \left(\frac{M_W - \frac{1000000}{CCT_setting}}{M_W - M_C}\right)$ |

The above correction factors for white light, generally calculated for a given CCT or mirek value, can then be applied to calculate an appropriate light-emitting element temperature correction using, in accordance with one embodiment of the present invention, the formulas in the following table.

| | Meaning |
|---|---|
| Input: | $T_{LK(R,G,B)}$ - LEE temperature correction factors<br>$CPI_{(R,G,B)}$ - Color point, intensity scaled<br>$TJ_{(R,G,B)}$ - LEE junction temperature |
| Output: | $CPI_{TC(R,C,B)}$ - Color Point temperature correction values<br>$Y_{0(R,G,B)}$ - Temperature corrected, target photodiode values |
| Constants: | None. |
| Transformation: | $CPI_{TC(R,G,B)} = Tj_{(R,G,B)} \times CPI_{(R,G,B)} \times T_{LK(R,G,B)}$<br>$Y_0 = CPI_{(R,G,B)} + CPI_{TC(R,G,B)}$ |

As will be apparent to the person skilled in the art, similar calculations may be implemented for colored light.

Similarly, temperature compensation of the sensor signals may be employed in embodiments of the present invention. Signals may be obtained from a number of different temperature sensors that may be analog to digital converted using an A/D converter. The following table provides an implementation of the use of temperature-corrected sensor signals, in accordance with one embodiment of the present invention.

| | Meaning |
|---|---|
| Input: | $T_{PHD}$ - Photodiode temperature from thermistor<br>$P_{(R,G,B)}$ - Photodiode measured values |
| Output: | $P_{TC(R,G,B)}$ - Photodiode temperature corrections<br>$Y_{(R,G,B)}$ - Temperature corrected, measured photodiode values<br>$Dk_{(RGB)}$ - Dark offset |
| Constants: | $T_{PK(R,G,B)}$ - Photodiode temperature correction factors |
| Transformation: | $P_{TC(R,G,B)} = T_{PHD} \times P_{(R,G,B)} \times T_{PK(R,G,B)} - Dk_{(R,G,B)}$<br>$Y_{(R,G,B)} = P_{(R,G,B)} + P_{TC(R,G,B)}$ |

In another embodiment of the present invention, the temperature compensation of the sensor signal may be approximated based on the setpoint $S_{(R,G,B)}$ instead of the actual instant sensor signal. In this embodiment, the sensor temperature correction can be defined as follows:

$$P_{TC(R,G,B)}=T_{PHD}\times S_{(R,G,B)}\times T_{PK(R,G,B)}-Dk_{(R,G,B)}$$

In this embodiment, the $P_{TC(R,G,B)}$ constant can be updated more quickly as it is based on the setpoint rather than the instant signal.

Example 6

It is well known that the sensitivity of the human eye to changes in light intensity is nonlinear. In other words, relative changes in intensity are not perceived as the same relative change in brightness. Rea, M., Ed. 2000 describes in "The IESNA Lighting Handbook", Ninth Edition. New York, N.Y.: Illuminating Engineering Society of North America, p. 27-4 how to use square law dimming to approximate linear brightness dimming. As is known perceptually linear dimming can be achieved by normalizing and then squaring the desired intensity. To achieve perceptually linear dimming with multicolor light sources such as for example RGB LED-based luminaires, it is necessary to determine the initial ratios of color intensities first and then maintain these ratios during dimming to be able also to maintain the same chromaticity at the desired new intensity. In one embodiment the control system can be configured for square law dimming using the following procedure:

```
Input: Rt, Gt, Bt
// Normalize RGB target values
Rnorm = Rt / Rmax
Gnorm = Gt / Gmax
Bnorm = Bt / Bmax
// Find maximum value
max = Rnorm
IF Gnorm > max
    max = Gnorm
ENDIF
IF Bnorm > max
    max = Bnorm
```

-continued

```
ENDIF
// Square RGB normalized values
Rnorm = Rnorm * max
Gnorm = Gnorm * max
Bnorm = Bnorm * max
// Output squared RGB values
R = Rnorm * Rmax
G = Gnorm * Gmax
B = Bnorm * Bmax
```

Example 7

As is well known Grassman's laws of color additivity are fulfilled in any linear color space such as for example CIE 1931 chromaticity, CIE 1976 UCS, or luminaire-specific RGB etc. To fade smoothly between two user-specified colors, it is therefore sufficient to interpolate linearly chromaticities along a straight line between the two specified colors. This, however, may require floating point instructions when implemented in a microcontroller or similar processing system and may slow down the performance of the control system. For real-time fading between initial and desired target colors and intensities, it is therefore useful to interpolate along a straight line using a differential digital analyzer algorithm as described, for example, by Ashdown in "Radiosity: A Programmer's Perspective", New York, N.Y.: John Wiley & Sons, pp. 200-202, (1994).

Example 8

In another embodiment suitable for example for applications requiring the generation of white light the control system can be configured with a contiguous set of piecewise linearized intervals of the blackbody locus that cover a desired range of color temperatures. Smooth white light fading between two user-specified color temperatures (CT) is then performed by linearly interpolating chromaticities along the piecewise linearized blackbody locus between the two user-specified CTs. In one embodiment, the CT intervals along the blackbody locus are evenly spaced in reciprocal color temperature. The typical unit used in the art is $10^{-6}\,K^{-1}$, also called microreciprocal Kelvin or mirek units. Linear interpolation in CIE 1976 UCS color space is then approximately equivalent to linear interpolation in the inverse CT space and the system can be calibrated to use practically relevant resolutions, for example, conveniently quantified in mireks.

Example 9

For applications requiring substantially maximal luminous flux output from the luminaire, the following method may be used:

```
Input: Rt, Gt and Bt
const Rmax, Gmax, Bmax
var Rnorm, Gnorm, Bnorm
var scale
var max
// Determine maximum target RGB value
max = Rt
IF max < Gt
    max = Gt
ENDIF
IF max < Bt
    max = Bt
```

-continued

```
ENDIF
// Normalize RGB values
Rnorm = Rt / max
Gnorm = Gt / max
Bnorm = Bt / max
// Determine scaling factor
scale = Rnorm / Rmax
IF scale < Gnorm / Gmax
    scale = Gnorm / Gmax
ENDIF
IF scale < Bnorm / Bmax
    scale = Bnorm / Bmax
ENDIF
// Maximize RGB target values
Rt = Rnorm / scale
Gt = Gnorm / scale
Bt = Bnorm / scale
```

where Rt, Gt, and Bt are the target RGB values before intensity dimming is applied. This algorithm can ensures that, in the absence of intensity dimming, the red, green, and blue LEDs are operated at substantially maximum intensity and the user-specified color.

The target RGB values need to be converted into pulse width modulation duty factors D for LEE drivers as described above or equivalently, current multipliers for analog LEE drivers. This can be accomplished by calculating:

$$[D_{Red} D_{Green} D_{blue}] = [R_t G_t B_t] Q \tag{14}$$

where:

$$Q = \begin{bmatrix} R_{red} & G_{red} & B_{red} \\ R_{green} & G_{green} & B_{green} \\ R_{blue} & G_{blue} & B_{blue} \end{bmatrix}^{-1} \tag{15}$$

in which each matrix element corresponds to the generated respective RGB sensor values for when the red, green and blue LEEs are operated at full intensity.

According to an embodiment of the present invention, input intensity scaling because of operating temperature may be required for two different reasons. Generally, the intensity will be limited to the lower of the two limits obtained. The first intensity scaling arises from limited LEE operating temperature. According to an embodiment, when a LEE temperature exceeds a predetermined maximum LEE operating temperature, for example, about 90° C., the maximum allowable intensity is scaled back according to a predetermined temperature de-rating table. An example table is given below. This will ensure that the LEE temperature does not exceed the maximum LEE temperature irrespective of the chromaticity or intensity setpoints. It is noted that for practical purposes the LEE junction temperature may not exceed the temperature inferred from a dedicated temperature sensor placed nearby by more than a certain offset temperature, for example, about 10° C. Therefore, the temperature de-rating table may be limited to about 80° C. The junction temperature of an LEE, however, may be directly inferred from its forward voltage which may render considering temperature offsets in the configuration of the feedback control system unnecessary.

In PWM controlled embodiments, the second intensity-scaling algorithm can ensure a constant chromaticity in the event that one of the PWM channels reaches its maximum. In one embodiment, the maximum allowable intensity is decremented when a PWM level reaches a first threshold value. The maximum intensity will increment if and when the largest PWM value drops below a second threshold value.

In general, as stated above, the system will typically use the lower intensity of the above two allowable intensity values. The following table outlines example intensity de- and rating, and provides example threshold and scaling values in accordance with one embodiment of the present invention.

| | Meaning |
|---|---|
| Input: | PWM (from previous iteration)<br>Current Intensity<br>$T_{PHD}$ - Photodiode temperature from thermistor |
| Output: | Current Scaled Intensity |
| Constants: | Temperature De-rating Table<br>PWM decrement and increment thresholds |
| Transformation: | See below |

| Substrate Temperature (° C.) | Maximum Intensity Scaled by Temperature |
|---|---|
| <=76 | 100 |
| 77 | 100 |
| 78 | 98 |
| 79 | 96 |
| 80 | 92 |
| 81 | 88 |
| 82 | 82 |
| 83 | 76 |
| 84 | 68 |
| 85 | 60 |
| 86 | 50 |
| 87 | 40 |
| 88 | 30 |
| 89 | 20 |
| 90 | 10 |
| >90 | 0 |

| PWM Value | Maximum Intensity Scaled by PWM reaching its maximum |
|---|---|
| 65280 | Decrement maximum Intensity by 1% |
| 64640 | Increment maximum Intensity by 1% |

Example 10

Figure 6:
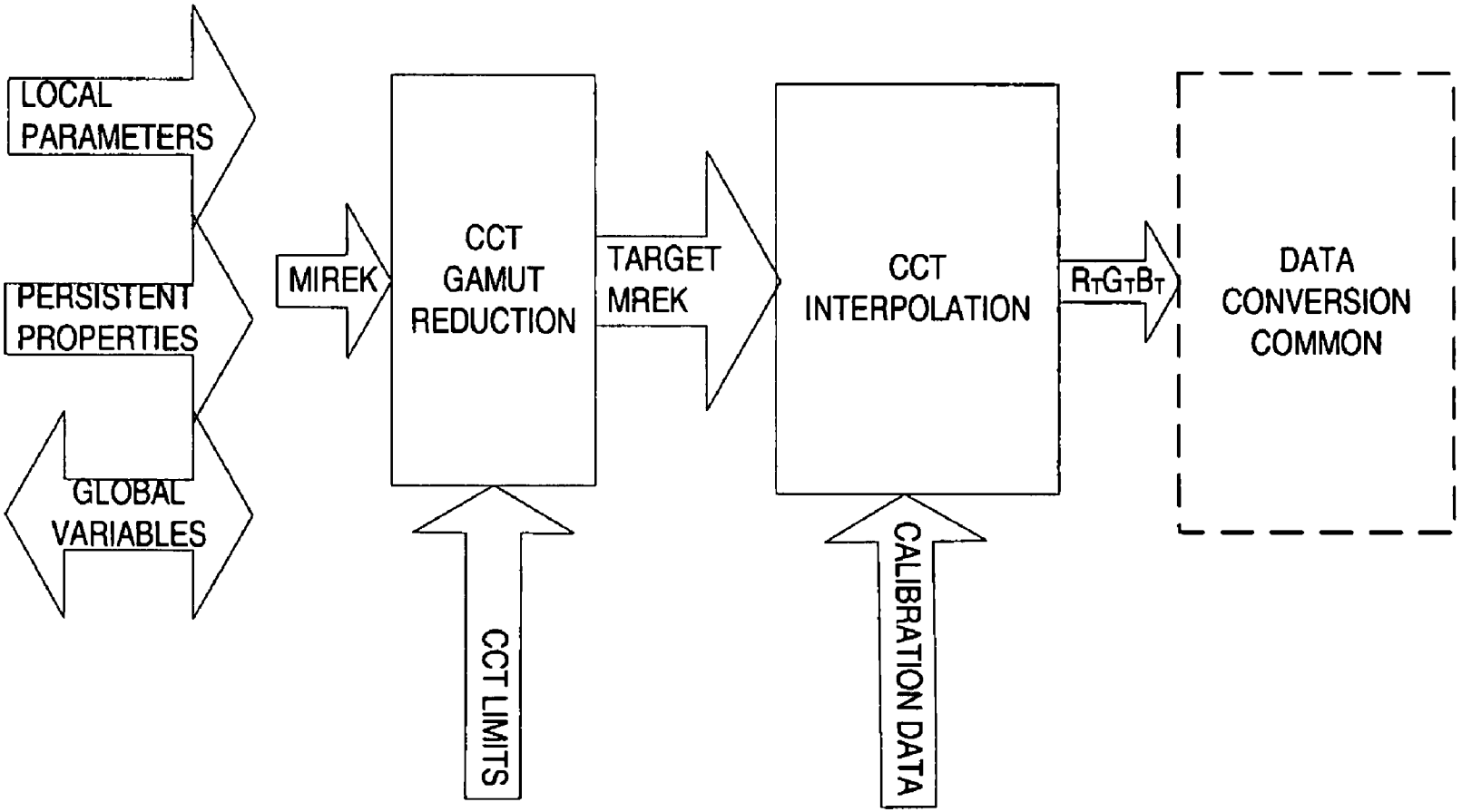
FIG. 6 illustrates a block diagram of an example process for white mode conversion according to one embodiment of the present invention.
Figure 7:
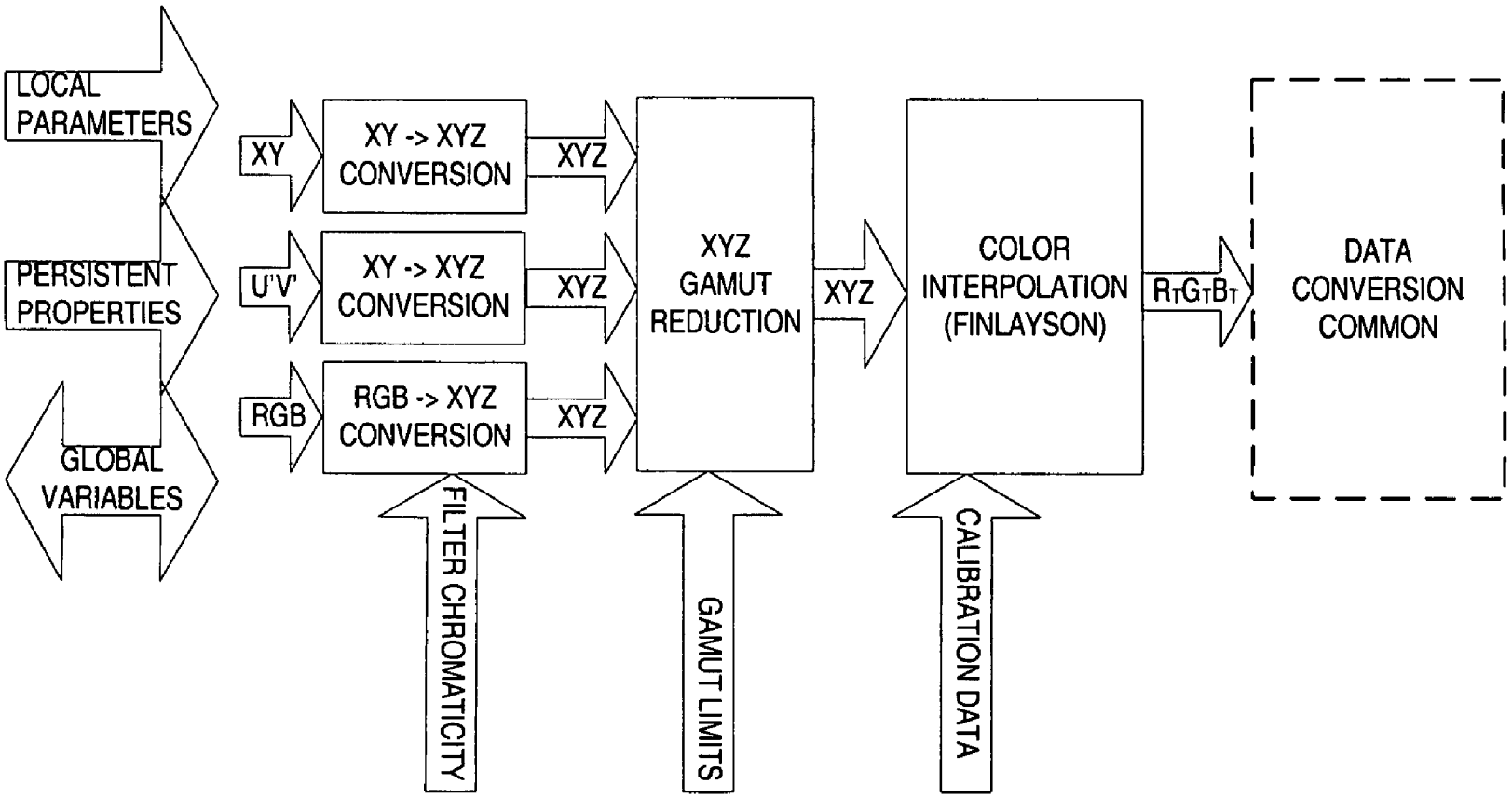
FIG. 7 illustrates a block diagram of an exemplary color gamut mapping process for chromaticity mode conversion according to one embodiment of the present invention.
Figure 8:
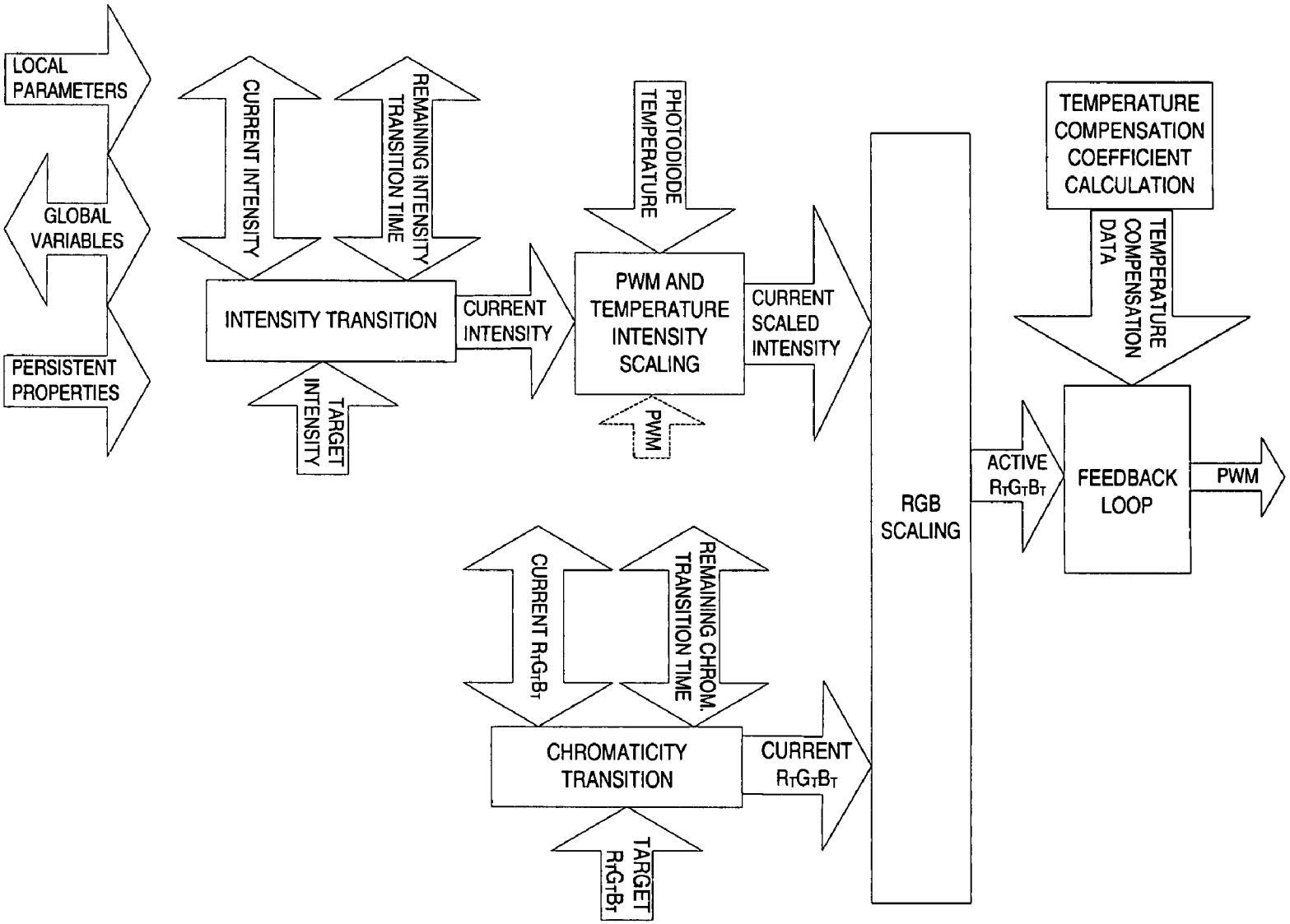
FIG. 8 illustrates a block diagram of an exemplary common conversion method according to one embodiment of the present invention.

As described, various data and parameters are manipulated by the feedback and control system. FIGS. 6, 7 and 8 provide further details concerning aspects of embodiments of the data conversions, representations and transformations of the present invention. The schematically illustrated embodiments of the used methods include three different types of data including local parameters, persistent properties and global variables. Local parameters are illustrated as solid arrows and represent function call parameters passed on for the sole use in a given function. Persistent properties are illustrated as dashed arrows, are managed by a separate control management firmware module, and are maintained in a non-volatile store. Global variables are illustrated as bold arrows and include temporary variables of global scope that are needed across various firmware modules. These embodiments may be implemented in firmware.

FIG. 6 illustrates a block diagram of an example process for white mode conversion used as part of the method employed to generate white light. The method comprises a CCT (correlated color temperature) gamut reduction process and a CCT interpolation process. The processes can be used to map input CCTs or chromaticities that exceed the gamut of the luminaire back onto respective achievable CCTs and chromaticities.

The CCT gamut reduction process ensures that the requested CCT is within the range of that which can be supported by the luminaire. The data may be calibrated in mirek and implemented as described in the following table.

| | Meaning |
|---|---|
| Input: | CCT |
| Output: | CCT |
| Constants: | Minimum CCT<br>Maximum CCT |
| Transformation: | IF Input < Maximum CCT<br>  Output = Maximum CCT<br>ELSE<br>  IF Input > Minimum CCT<br>  Output = Minimum CCT<br>  ELSE<br>  Output = Input<br>  ENDIF<br>ENDIF |

According to an embodiment, the CCT interpolation process is used to map input CCT values into the setpoint values for the one or more optical sensors. The interpolation process outlined in the table below is thus run for every color channel, for example, three times for RGB-based luminaire, to calculate the target sensor signals in the target color space.

| | Meaning |
|---|---|
| Input: | CCT |
| Output: | $CP_{(RGB)}$ - Color Point, no intensity scaling |
| Constants: | CCT Calibration Array |
| Transformation: | Linear interpolation is done among the calibrated CCT points. This is done through the following steps (Note: Following algorithm assumes CCT values were stored in sequential order, from lowest to highest during the calibration process and requested CCT falls between lowest to highest calibrated points):<br>IF user-defined CCTi is equal to one of the CCT calibration points e.g. CCTn<br>  CCTi.red = CCTn.red<br>  CCTi.green = CCTn.green<br>  CCTi.blue = CCTn.blue<br>ELSE<br>  Find the two calibration points which the user - defined CCTi falls in between e.g CCT1 and CCT2. Perform linear interpolation between two setpoints and user-defined CCTi<br>  cct_step = CCT2.cct − CCT1.cct<br>  point_to_int = CCTi.cct − CCT1.cct<br>  deltaX1 = (cct_step − point_to_int)/cct_step)<br>  deltaX2 = (point_to_int/cct_step)<br>  CCTi.red = (CCT1.red * deltaX1) + (CCT2.red * deltaX2)<br>  CCTi.green = (CCT1.green * deltaX1) + (CCT2.green * deltaX2)<br>  CCTi.blue = (CCT1.blue * deltaX1) + (CCT2.blue * deltaX2);<br>ENDIF |

FIG. 7 illustrates a block diagram of an example color gamut mapping process for chromaticity mode conversion used as part of the method employed to generate colored light of desired chromaticity in a desired color space. The chromaticity mode conversion is similar to the CCT conversion illustrated in FIG. 6. The gamut mapping process is used to map/reduce input chromaticities that are outside the gamut of the luminaire back onto a proximate chromaticity within the gamut. An example embodiment using u'v' chromaticity coordinates is illustrated in the following table.

| | Meaning |
|---|---|
| Input: | u'v' |
| Output: | u'v' |
| Constants: | Corner points of supported gamut |
| Transformation: | The u'v' output value from Gamut Reduction shall be the intersection point of the line between the u'v' input & the centre point of Color Gamut and Color Gamut itself.<br>ml1 = ((pi.coor2) − D65.coor2)/((pi.coor1) − D65.coor1);<br>  bl1 = D65.coor2 − (ml1 * D65.coor1);<br>  ml2 = (Gx.coor2 − Rx.coor2)/(Gx.coor1 − Rx.coor1);<br>  bl2 = Rx.coor2 − (m12 * Rx.coor1);<br>  pc.coor1 = (bl2 − bl1)/(ml1 − ml2);<br>  pc.coor2 = (ml2 * pc.coor1) + bl2; |

The colour interpolation module illustrated FIG. 7 is used to output a target colour point, for example, $R_tG_tB_t$, and can be implemented, in one embodiment, as described in the following table.

| | Meaning |
|---|---|
| Input: | XYZ |
| Output: | $R_tG_tB_t$ - Color point, no intensity scaling |
| Constants: | M - XYZ Calibration Array |
| Transformation: | $R_t$ = M[1][1] * X + M[1][2] * Y + M[1][3] * Z<br>$G_t$ = M[[2][1] * X + M[2][2] * Y + M[2][3] * Z<br>$B_t$ = M[3][1] * X + M[3][2] * Y + M[3][3] * Z<br>Determine maximum target RGB value<br>max = $R_t$<br>IF max < $G_t$<br>  max = $G_t$<br>ENDIF<br>IF max < $B_t$<br>  Max = $B_t$<br>ENDIF<br>Normalize target RGB values<br>$R_{norm}$ = $R_t$ / max<br>$G_{norm}$ = $G_t$ / max<br>$B_{norm}$ = $B_t$ / max<br>Determine scaling factor<br>scale = $R_{norm}$ / $R_{max}$<br>IF scale < $G_{norm}$ / $G_{max}$<br>  scale = $G_{norm}$ / $G_{max}$<br>ENDIF<br>IF scale < $B_{norm}$ / $B_{max}$<br>  scale = $B_{norm}$ / $B_{max}$<br>ENDIF<br>Maximize target RGB values<br>$R_t$ = $R_{norm}$ / scale<br>$G_t$ = $G_{norm}$ / scale<br>$B_t$ = $B_{norm}$ / scale |

FIG. 8 illustrates a block diagram of an example common conversion method, as used in both described colour and white mode conversion methods. The following tables provide example implementations of each submodule of the common conversion method.

An intensity transition can be performed and implemented as described in the following table.

| | Meaning |
|---|---|
| Input: | Current Intensity % (CI)<br>Target Intensity % (TI)<br>Remaining Intensity Transition Time (RITT) |

-continued

| | Meaning |
|---|---|
| Output: | Current Intensity<br>Remaining Transition Time |
| Constants: | Cycle Time (Length of time between cycles of the algorithm) (CT) |
| Transformation: | CI = (TI − CI)/(RITT/CT) + CI<br>RITT = RITT − CT |

A chromaticity transition can be performed and implemented as described in the following table.

| | Meaning |
|---|---|
| Input: | Current Sensor Target for Red, Green and Blue ($CST_X$)<br>Target Sensor Target for Red, Green and Blue ($TST_X$)<br>Remaining Chromaticity Transition Time (RCTT) |
| Output: | Current Sensor Target for Red, Green and Blue ($CST_X$)<br>Remaining Chromaticity Transition Time |
| Constants: | Cycle Time (Length of time between cycles of the algorithm) (CT) |
| Transformation: | $CST_R = (TST_R - CST_R)/(RCTT/CT) + CST_R$<br>$CST_G = (TST_G - CST_G)/(RCTT/CT) + CST_G$<br>$CST_B = (TST_B - CST_B)/(RCTT/CT) + CST_B$<br>RCST = RCST − CT |

An $R_tG_tB_t$ scaling can be performed and implemented as described in the following table.

| | Meaning |
|---|---|
| Input: | Current $R_tG_tB_t$<br>Current Intensity<br>Dimming Curve |
| Output: | Active $R_tG_tB_t$ |
| Constants: | Dimming Curve Table (DCT) |
| Transformation: | Active $R_t$ = Current $R_t$ * DCT(Dimming Curve, Current Intensity)<br>Active $G_t$ = Current $G_t$ * DCT(Dimming Curve, Current Intensity)<br>Active $B_t$ = Current $B_t$ * DCT(Dimming Curve, Current Intensity) |

Example 11

Figure 9:
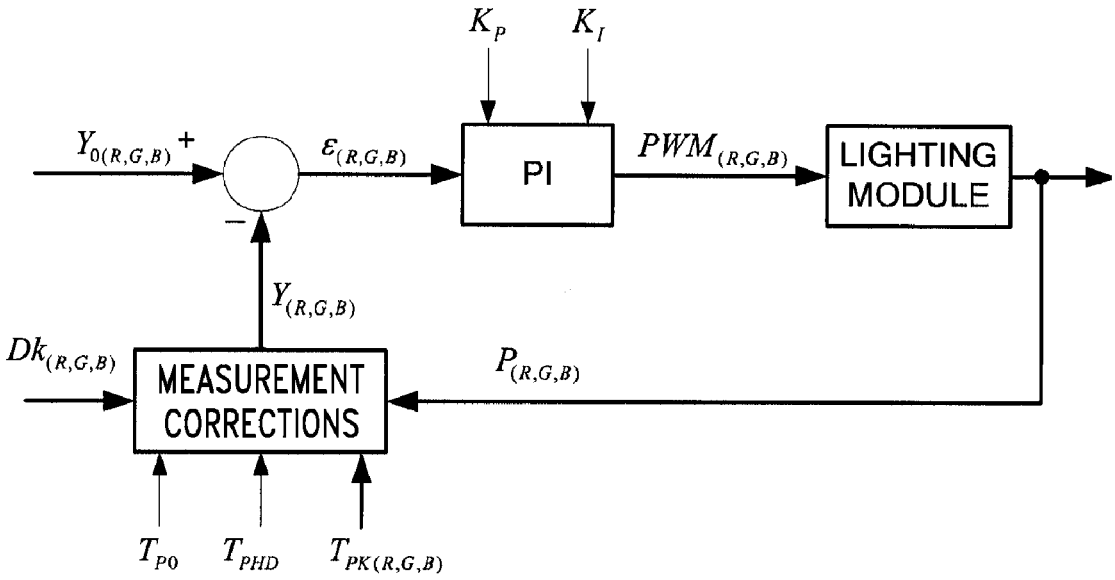
FIG. 9 illustrates schematically a feedback and control system employing a PI control scheme according to one embodiment of the present invention.

An example embodiment of the feedback and control system employing a proportional-integral (PI) feedback control scheme is schematically illustrated in FIG. 9. The example can be implemented using the equations provide in the following table. As illustrated, the embodiment does not derive a derivative (D) signal from the difference signal between setpoint and instant output. It would be readily understood that there are a plurality of alternative P, I or D control element combinations.

| | Meaning |
|---|---|
| Input: | $Y_{0(RGB)}$ - Temperature corrected, intensity scaled, target photodiode values<br>$Y_{(RGB)}$ - Temperature corrected, photodiode measured values<br>$\epsilon_{SUM(RGB)}$ - Sum of all previous process errors |

-continued

| | Meaning |
|---|---|
| Outputs: | $\epsilon_{(RGB)}$ - Process error.<br>$PWM_{(RGB)}$ - Output PWM waveform to the LED drivers |
| Constants: | $K_p$ - Proportional constant<br>$K_I$ - Integral constant |
| Transformation: | Equations for implementing this transformation include:<br>$\varepsilon_{(R,G,B)} = Y_{0(R,G,B)} - Y_{(R,G,B)}$<br>$PWM_{(R,G,B)} + = K_P \times \varepsilon_{(R,G,B)} + K_I \times \sum_{i=0}^{-\infty} \varepsilon_{i(R,G,B)}$ |

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

We claim:

1. A method for controlling one or more light-emitting elements (LEEs) driven by forward currents to generate a mixed light, said method comprising the steps of:

a) acquiring sensor data representative of the mixed light;

b) providing setpoint data representative of a desired mixed light;

c) transforming the sensor data into first data expressed in coordinates of a predetermined color coordinate system;

d) transforming the setpoint data into second data expressed in coordinates of said predetermined color coordinate system;

e) comparing the first and the second data and determining a difference between the first and the second data;

f) adjusting said forward currents in response to the difference between the first and the second data in order to decrease the difference between said first data and said second data; and repeating steps a) through f) until an absolute value of said difference falls below a predetermined threshold.

2. The method according to claim 1 wherein the predetermined color coordinate system corresponds to the CIE xyY chromaticity coordinate system.

3. The method according to claim 1 wherein the predetermined color coordinate system corresponds to the CIE u'v'Y chromaticity coordinate system.

4. The method according to claim 1 wherein the sensor data is provided by one or more optical sensors each providing a responsivity at predetermined operating conditions of the corresponding sensor, each responsivity defining one basis function of the predetermined color coordinate system.

5. The method according to claim 1 wherein the sensor data comprises information representative of weighted averages of one or more response functions.

6. The method as described in claim 1 wherein the setpoint data is provided via a user interface.

7. The method according to claim 1 wherein linear variations of intensity of the light when expressed in the predetermined color coordinate system correspond to substantially linear perceived intensity variations of the emitted light.

8. The method according to claim 1, wherein the sensor data is provided by a predetermined number of sensors and the predetermined number corresponds with the number of different nominal colors of the one or more LEEs.

9. The method according to claim 8, wherein the predetermined number of sensors corresponds with the number of forward currents.

10. The method according to claim 1, wherein transforming the sensor data comprises performing a first linear transformation.

11. The method according to claim 1, wherein transforming the setpoint data comprises performing a second linear transformation.

12. The method according to any one of claim 1 to claim 11 for use in a feedback control system.

13. A system for controlling one or more light-emitting elements (LEEs) driven by forward currents to generate a mixed light, the system comprising:

a) one or more optical sensors for acquiring sensor data representative of the mixed light;

b) a user interface for providing setpoint data representative of a desired mixed light;

c) a controller, the controller transforming the sensor data into first data expressed in coordinates of a predetermined color coordinate system, the controller further transforming the setpoint data into second data expressed in coordinates of said predetermined color coordinate system, the controller further comparing the first and the second data and determining a difference between the first and the second data, the controller further adjusting said forward currents in response to the difference between the first and the second data; wherein the controller is configured to decrease the difference between said first data and said second data until an absolute value of said difference falls below a predetermined threshold.

14. The system according to claim 13, wherein the predetermined color coordinate system corresponds to the CIE xyY chromaticity coordinate system.

15. The system according to claim 13, wherein the predetermined color coordinate system corresponds to the CIE u'v'Y chromaticity coordinate system.

16. The system according to claim 13, wherein each of said one or more optical sensors provides a responsivity at predetermined operating conditions and each responsivity defines one basis function of the predetermined color coordinate system.

17. The system according to claim 13, wherein the sensor data comprises information representative of weighted averages of one or more response functions.

18. The system according to claim 13, wherein linear variations of intensity of the light when expressed in the predetermined color coordinate system correspond to substantially linear perceived intensity variations of the emitted light.

19. The system according to claim 13, wherein the sensor data is provided by a predetermined number of sensors and the predetermined number corresponds with the number of different nominal colors of the one or more LEEs.

20. The system according to claim 13, wherein the predetermined number of sensors corresponds with the number of forward currents.

21. The system according to claim 13, wherein transforming the sensor data comprises performing a first linear transformation.

22. The system according to claim 14, wherein transforming the setpoint data comprises performing a second linear transformation.

* * * * *